US007168565B2

(12) United States Patent
Scott

(10) Patent No.: US 7,168,565 B2
(45) Date of Patent: Jan. 30, 2007

(54) PACKAGING SYSTEM

(75) Inventor: Terry A. Scott, East Greenwich, RI (US)

(73) Assignee: Hasbro, Inc., Pawtucket, RI (US)

( * ) Notice: Subject to any disclaimer, the term of this patent is extended or adjusted under 35 U.S.C. 154(b) by 269 days.

(21) Appl. No.: 10/620,838

(22) Filed: Jul. 16, 2003

(65) Prior Publication Data

US 2005/0011792 A1 Jan. 20, 2005

(51) Int. Cl.
*B65D 73/00* (2006.01)

(52) U.S. Cl. ..... 206/471; 206/459.5

(58) Field of Classification Search ..... 206/461, 206/464, 467, 468, 469, 470, 471, 216, 223, 206/575, 579, 581, 459.5, 38
See application file for complete search history.

(56) References Cited

U.S. PATENT DOCUMENTS 4,499,353 A * 2/1985 Shields ..... 206/470
4,512,474 A * 4/1985 Harding ..... 206/461
5,129,517 A * 7/1992 Hustad ..... 206/467
D350,693 S 9/1994 Pratt
5,551,570 A 9/1996 Shaffer et al.
D383,385 S 9/1997 Hayduk et al.
5,788,105 A * 8/1998 Foos ..... 220/266
6,086,482 A * 7/2000 Voden ..... 473/41
6,152,298 A 11/2000 Dods
6,227,369 B1 5/2001 Glassman
6,330,945 B1 * 12/2001 Reimer ..... 206/470
6,409,019 B1 6/2002 Hornsby et al.
6,474,471 B1 * 11/2002 Miyake ..... 206/316.2
D469,348 S * 1/2003 Demus et al. ..... D9/415
D480,964 S * 10/2003 Lee ..... D9/415
D484,043 S * 12/2003 Hwang et al. ..... D9/415
D503,282 S * 3/2005 Murphy ..... D4/199
2001/0007308 A1 7/2001 Glassman

* cited by examiner

*Primary Examiner*—Shian T. Luong
(74) *Attorney, Agent, or Firm*—Marshall, Gerstein & Borun LLP

(57) ABSTRACT

A packaging system is disclosed. The packaging system comprises a container having a rim defining an open end; and a carrying assembly having a first portion for securely capturing the container rim and a second portion comprising a blister package. The blister package includes a blister section forming a carrying handle for the system.

35 Claims, 2 Drawing Sheets

PACKAGING SYSTEM

BACKGROUND OF THE INVENTION

Packaging systems for packaging, promoting and displaying product, such as toys, for retail sale, are well known. To better promote the sale of the product, the packaging system ought to attractively display the product. The packaging system ought to, as well, provide display information to potential purchasers and provide an easy means of carrying the packaging system.

SUMMARY OF THE INVENTION

It is an object of the invention to provide a packaging system, such as for packaging a collection of toys for retail sales.

In accordance with the invention, the packaging system comprises a container having a rim defining an open end, and a carrying assembly having a first portion for securely capturing the container rim and a second portion comprising a blister package. The blister package includes a blister section forming a carrying handle for the system.

It is contemplated that the blister package is generally arch shaped.

It is further contemplated that the blister package includes blister sections on opposing sides thereof to form the carrying handle.

It is still further contemplated that the blister section on one of the opposing sides is formed with an enlarged perimeter portion generally following the arch-shape of the blister package. The blister section on the other of the opposing sides may be formed with an enlarged perimeter portion generally following the arch-shape of the blister package. The blister section on the other of the opposing sides may include a recess which cooperates with the enlarged perimeter portion as the handle.

It is yet further contemplated that the blister package includes blister portions for receiving display items. The blister package may also include a display card in the blister package.

It is further contemplated that the packaging system includes an upper supporting surface, and means, such as projections or a circumferential ridge, for supporting the upper supporting surface within the container. The upper supporting surface may include shaped deformations for receiving items of display.

It is further contemplated that the packaging system includes a lower supporting surface disposed below the upper supporting surface and defining a space. The space is adapted to contain display items.

It is further contemplated that the packaging system includes a cover adapted for closing the open end of the container. The cover is disposed within the blister package.

Other features and advantages of the present invention will be apparent to those of ordinary skill in the art in view of the detailed description of the preferred embodiment, which is made with reference to the drawings, a brief description of which is provided below.

DETAILED DESCRIPTION OF A PREFERRED EMBODIMENT

Figure 1:
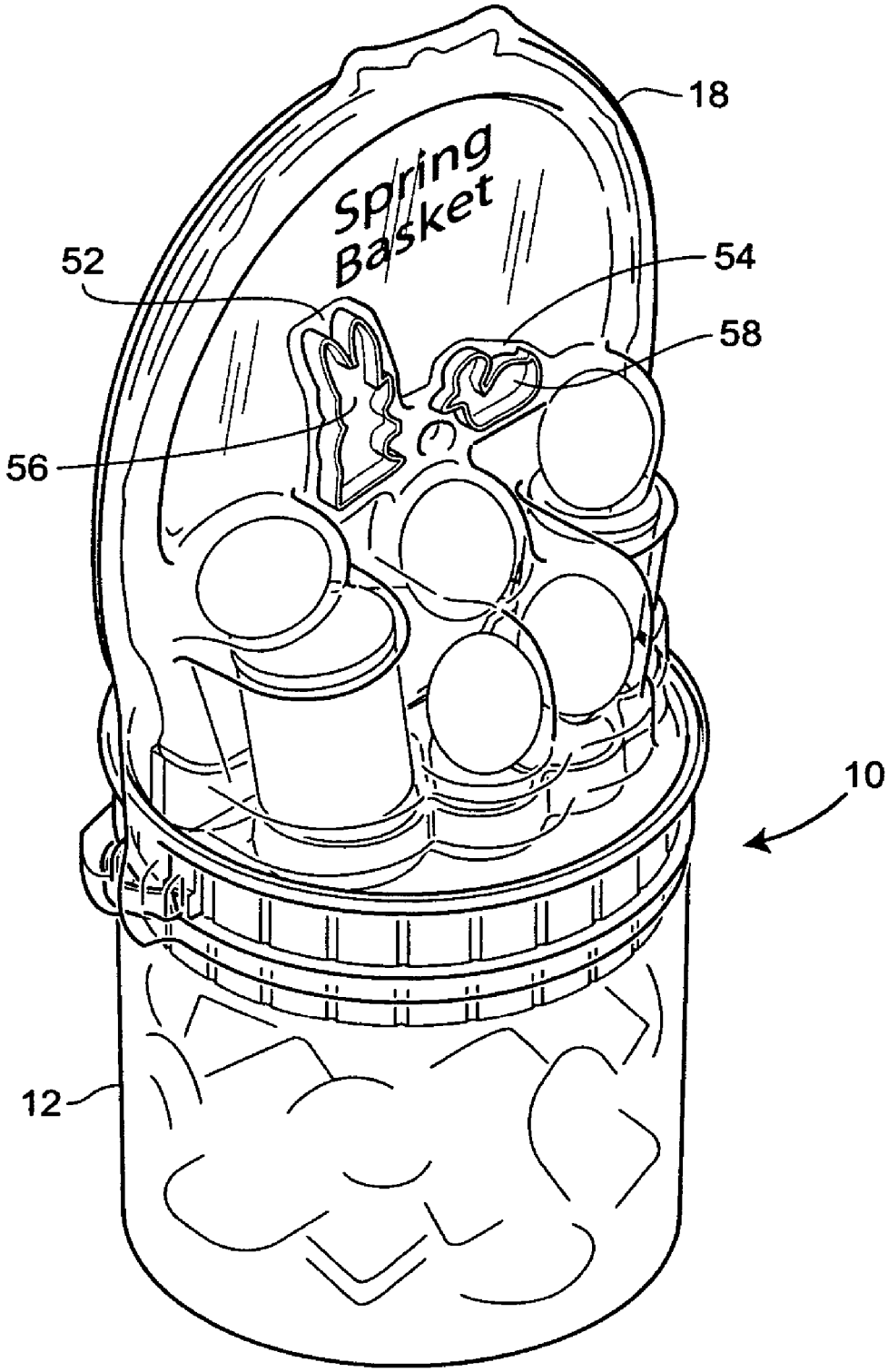
FIG. 1 is an perspective view of a packaging system in accordance with the invention.
Figure 2:
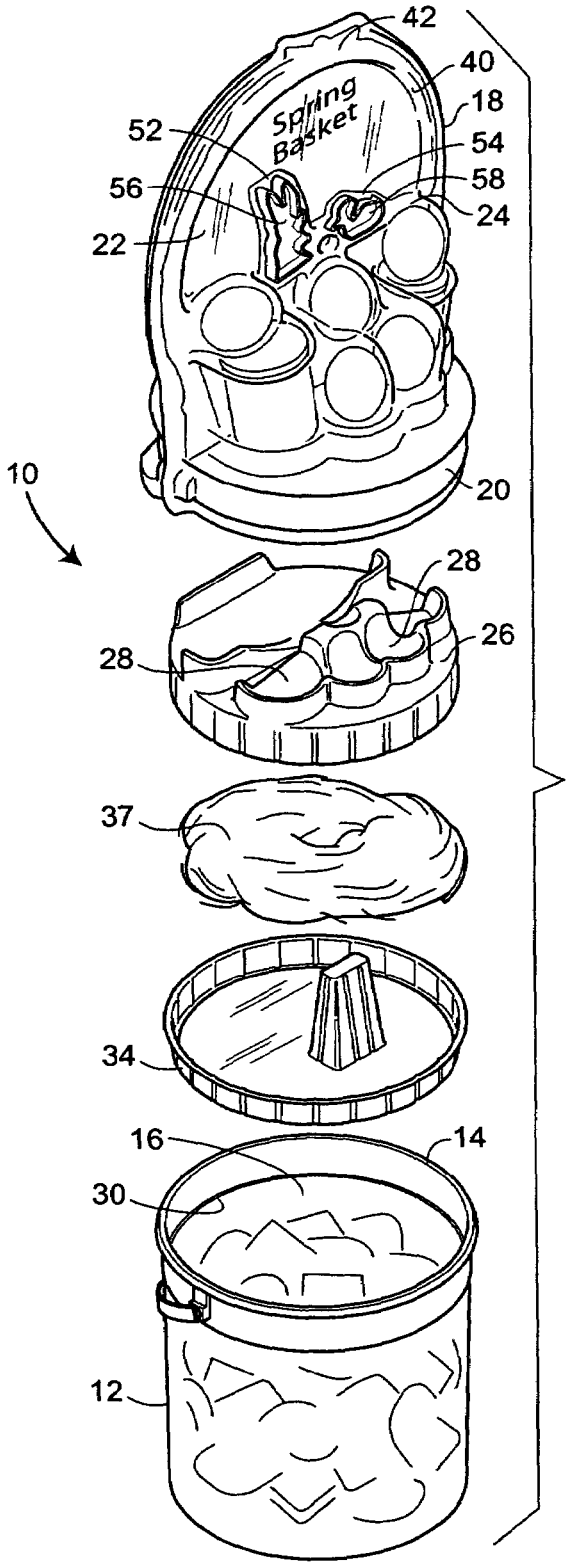
FIG. 2 is an exploded view of the packaging system of FIG. 1.
Figure 3:
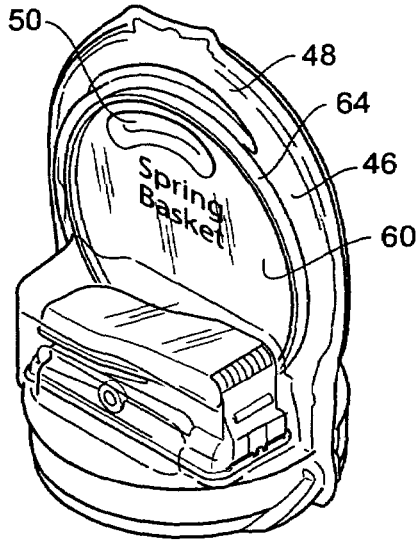
FIG. 3 is a rear view of a carrying assembly of the packaging system of FIG. 1.

A packaging system 10 in accordance with the invention is illustrated in the Figures. The packaging system 10 can be used to contain and display items, such as children's toys. In the disclosed embodiment, the packaging system 10 is in the form of a seasonal Easter basket, although other forms are contemplated without departing from the spirit of the invention.

The packaging system 10 comprises a generally cylindrical container 12 having a rim 14 defining an open end 16. The packaging system 10 further includes a carrying assembly 18. The carrying assembly 18 has a first portion 20 for securely capturing and retaining the container rim 14 and a second, generally arch-shaped portion 22 comprising a blister package 24. The blister package 24 includes blister sections, discussed below, on opposing sides thereof to form a carrying handle for the system 10. When the carrying assembly 18 is securely installed over the container rim 14, the carrying handle can be used to lift the entire packaging system 10.

The packaging system 10 further includes an upper supporting surface 26. The upper supporting surface 26 includes shaped deformations 28 for receiving the items of display.

Figure 4:
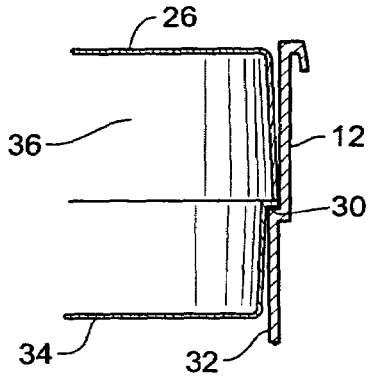
FIG. 4 is a detail view of a portion of the packaging system of FIG. 1.

As shown particularly in FIG. 4, the packaging system 10 also includes a circumferential ridge 30 extending about an inner surface 32 of the container 12 for supporting the upper supporting surface 26 within the container 12. A lower supporting surface 34 is disposed below the upper supporting surface 26 and defines a space 36. The space 36 is adapted to contain display material 37, such as synthetic Easter grass.

A first blister section 40 on one of the opposing sides is formed with an enlarged perimeter portion 42 generally following the arch-shape of the blister package 24. A second blister section 46 (FIG. 4) on the other of the opposing sides is formed with an enlarged perimeter portion 48 also generally following the arch-shape of the blister package 24. Additionally the other of the opposing sides includes a recess 50 which cooperates with the enlarged perimeter portion 48 as a handle.

The blister package 24 also includes blister portions 52, 54 for receiving additional display items 56, 58, respectively. A display card 60 is also disposed in the blister package 24. Additionally, a cover 64, adapted for closing the open end of the container, is disposed within the blister package 24.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A packaging system comprising:

a container having a rim defining an open end; and a blister package including a first blister section and a second blister section disposed on opposite sides of the blister package and connected to each other along their outer edges to form the blister package, wherein the connected sections define at least one blister portion for receiving an item to be displayed by the blister package, wherein the connected sections form a carrying handle for the system, and wherein the connected sections define a lower portion configured to engage the rim of the container so that the carrying handle is engageable to lift the blister package and the container connected to the lower portion.

2. The packaging system of claim 1 wherein the blister package is generally arch shaped.

3. The packaging system of claim 1 wherein the blister section on one of the opposing sides is formed with an enlarged perimeter portion generally following the arch-shape of the blister package.

4. The packaging system of claim 3 wherein the blister section on the other of the opposing sides is formed with an enlarged perimeter portion generally following the arch-shape of the blister package.

5. The packaging system of claim 3 wherein the other of the opposing sides includes a recess which cooperates with the enlarged perimeter portion as a handle.

6. The packaging system of claim 1 wherein the blister package includes a plurality of blister portions for receiving display items.

7. The packaging system of claim 1 including a display card in the blister package.

8. The packaging system of claim 1 including an upper supporting surface, and means for supporting the upper supporting surface within the container.

9. The packaging system of claim 8 wherein the upper supporting surface supporting means comprises a projection extending inwardly from the container to supportingly engage the upper supporting surface.

10. The packaging system of claim 9, including a plurality of the projections extending inwardly from the container to supportingly engage the upper supporting surface.

11. The packaging system of claim 10 wherein the plurality of projections form a circumferential ridge.

12. The packaging system of claim 8 wherein the upper supporting surface includes shaped deformations for receiving items of display.

13. The packaging system of claim 8 including a lower supporting surface disposed below the upper supporting surface and defining a space, the space adapted to contain a display item.

14. The packaging system of claim 1 including a cover adapted for closing the open end of the container, wherein the cover is disposed within the blister package.

15. The packaging system of claim 1 wherein the container is disposed external to the blister package when the lower portion engages the rim of the container.

16. A packaging system comprising:

a container having a rim defining an open end; and a generally arch-shaped blister package including first and second blister sections on opposing sides thereof connected to each other along their outer edges to form the blister package, wherein the connected sections define at least one blister portion for receiving an item to be displayed by the blister package, wherein the connected sections cooperatively form a carrying handle for the system, and wherein the connected configured to engage the rim of the container so that the carrying handle is engageable to lift the blister package and the container connected to the lower portion.

17. The packaging system of claim 16 wherein the blister section on one of the opposing sides is formed with an enlarged perimeter portion generally following the arch-shape of the blister package.

18. The packaging system of claim 17 wherein the blister section on the other of the opposing sides is formed with an enlarged perimeter portion generally following the arch-shape of the blister package.

19. The packaging system of claim 17 wherein the other of the opposing sides includes a recess which cooperates with the enlarged perimeter portion as a handle.

20. The packaging system of claim 16 wherein the blister package includes a plurality of blister portions for receiving display items.

21. The packaging system of claim 16 including a display card in the blister package.

22. The packaging system of claim 16 including an upper supporting surface, and means for supporting the upper supporting surface within the container.

23. The packaging system of claim 22 wherein the upper supporting surface supporting means comprises a projection extending inwardly from the container to supportingly engage the upper supporting surface.

24. The packaging system of claim 23 including a plurality of the projections extending inwardly from the container to supportingly engage the upper supporting surface.

25. The packaging system of claim 24 wherein the plurality of projections form a circumferential ridge.

26. The packaging system of claim 22 wherein the upper supporting surface includes shaped deformations for receiving items of display.

27. The packaging system of claim 16 including a cover adapted for closing the open end of the container, wherein the cover is disposed within the blister package.

28. The packaging system of claim 16 wherein the container is disposed external to the blister package when the lower portion engages the rim of the container.

29. A packaging system comprising:

a container having a rim defining an open end;

a carrying assembly having a first portion for securely capturing the container rim and a second, generally arch-shaped portion comprising a blister package, the blister package including blister sections on opposing sides thereof to form a carrying handle for the system;

an upper supporting surface, the upper supporting surface including shaped deformations for receiving items of display;

circumferential ridge extending about an inner surface of the container for supporting the upper supporting surface within the container; and a lower supporting surface disposed below the upper supporting surface and defining a space, the space adapted to contain display material.

30. The packaging system of claim 29 wherein the blister section on one of the opposing sides is formed with an enlarged perimeter portion generally following the arch-shape of the blister package.

31. The packaging system of claim 30 wherein the blister section on the other of the opposing sides is formed with an enlarged perimeter portion generally following the arch-shape of the blister package.

32. The packaging system of claim 31 wherein the other of the opposing sides includes a recess which cooperates with the enlarged perimeter portion as a handle.

33. The packaging system of claim 29 wherein the blister package includes blister portions for receiving display items.

34. The packaging system of claim 29 including a display card in the blister package.

35. The packaging system of claim 29 including a cover adapted for closing the open end of the container, wherein the cover is disposed within the blister package.

* * * * *